United States Patent [19]

Weaver et al.

[11] Patent Number: 4,936,075

[45] Date of Patent: Jun. 26, 1990

[54] PACKAGING

[75] Inventors: Eric R. Weaver; Norman G. Matheson, both of Auckland, New Zealand

[73] Assignee: N. Z. Forest Products Limited, Penrose-Auckland, New Zealand

[21] Appl. No.: 775,719

[22] Filed: Sep. 16, 1985

Related U.S. Application Data

[63] Continuation of Ser. No. 637,822, Aug. 6, 1984, abandoned.

[30] Foreign Application Priority Data

Aug. 4, 1983 [NZ] New Zealand ..... 205149

[51] Int. Cl.[5] ..... B61D 21/00

[52] U.S. Cl. ..... 53/443; 53/473; 206/521.1; 206/821; 206/501

[58] Field of Search ..... 206/821, 521.1, 521; 53/473, 443

[56] References Cited

U.S. PATENT DOCUMENTS

| | | | |
|---|---|---|---|
| 3,319,865 | 5/1967 | Livas | 229/2.5 EC |
| 3,392,902 | 7/1968 | Donovan | 229/2.5 EC |
| 3,715,071 | 2/1973 | Flynn | 229/2.5 EC |
| 3,756,429 | 9/1973 | Fleisater et al. | 206/501 |

FOREIGN PATENT DOCUMENTS

| | | | |
|---|---|---|---|
| 636916 | 2/1962 | Canada | 229/2.5 EC |
| 1905991 | 8/1969 | Fed. Rep. of Germany | 229/2.5 EC |
| 2450753 | 11/1980 | France | 206/501 |

*Primary Examiner*—Joseph M. Moy

*Attorney, Agent, or Firm*—Fleit, Jacobson, Cohn, Price, Holman & Stern

[57] ABSTRACT

The invention relates to a method of packaging kiwifruit in packaging means formed or provided with one or more pockets therein, the method including locating at least one kiwifruit in at least one pocket, so that the longitudinal axis of the kiwifruit are substantially vertical or upright. In one form of the invention, the method uses packaging means in the form of a tray including a plurality of juxtaposed pockets, each pocket having at least one deformable nipple on the base thereof. The invention also provides packaging means for kiwifruit which include at least one pocket, the pocket being adapted to house at least one kiwifruit in a position such that the longitudinal axis thereof is substantially vertical or upright. In a preferred form of the invention, the packaging means is in the form of a tray incorporating a plurality of juxtaposed pockets. At least one pocket is provided with at least one deformable nipple on its base.

2 Claims, 1 Drawing Sheet

PACKAGING

This is a continuation of application Ser. No. 637,822, filed Aug. 6, 1984, now abandoned.

BACKGROUND TO THE PRESENT INVENTION

This invention relates to packaging and in particular relates to the packaging, storage and transportation of the fruit of actinidia, which is commonly known as "Chinese Gooseberry" or "Kiwifruit". Such fruit will hereinafter be referred to throughout the specification and claims as "Kiwifruit".

Kiwifruit is grown commercially in New Zealand on a relatively large scale and during recent years has been exported in increasingly large quantities. Such exports have involved packaging and transport to numerous countries throughout the world.

The kiwifruit basically includes two varieties commonly known as "Bruno" and "Hayward". The usual practise is to graft wood from good Hayward plants onto seeklings.

While New Zealand is by far the world leader in kiwifruit production there have been significant plants throughout the world in recent years as the extraordinary success of the New Zealand export crops has stimulated interest. In the Southern Hemisphere plantings are recorded in Australia, Chile, Brazil, Argentina, South Africa and Zimbabwe, and these will compete directly with the New Zealand crop in the market. Northern Hemisphere plantings are recorded in United States of America, Italy, France, Japan, Greece, Portugal, Israel, Spain, China (where the original vines grow wild), and the Republic of Korea. All of these countries have received kiwifruit stock plants exported from New Zealand.

The kiwifruit industry and in particular the New Zealand kiwifruit industry has been characterised by the great distance between the grower and market as most of the fruit is exported and sold in the Northern Hemisphere. Thus, it is essential that the fruit arrives at the market in a good condition, ready for sale and use. Thus, it is usually picked before it is fully ripe, and while it is still in a relatively firm condition, it is packed, stored and transported. Usually this is in a carefully controlled temperature environment.

Up until this time, typical packaging used for kiwifruit has included a moulded plastic tray housed in a box such as a shallow box. The moulded plastic tray has included pockets which are let down or moulded from the upper surface of the tray, and which are so shaped as to accommodate kiwifruit in a manner in which their longitudinal axes are substantially co-axial with or horizontal to, the longitudinal axis of or horizontal plane of the surface of the tray. In other words, the kiwifruit have been packed lying on their sides with the longitudinal axes of the kiwifruit being substantially co-axial or parallel with the longitudinal axis of the tray.

In this manner, the sides of the kiwifruit have been exposed in the trays rather than the ends.

It is said that in the early years of production of kiwifruit for export, the fruit was packed for this purpose on a bed of woodwool placed in a common timber or cardboard fruit box.

The fruit was laid on the woodwool to protect it from damage and to provide a pleasing appearance and presentation which was considered an important factor in its marketing.

Right from the infancy of the kiwifruit industry the fruit has always been packed laying on its side in the box, (that is with the longitudinal axis of the kiwifruit being substantially co-axial with or parallel with the horizontal plane of the box). This has continued up until this day. By the mid 1960's the kiwifruit industry in New Zealand had developed to a stage where greater consideration had to be given to the packaging of the fruit. Thus, consideration was given to more efficient packaging and the evolution of a satisfactory grading system for the fruit. As a result of this, the woodwool was discarded from the box and a plastic tray was introduced while the orientation of the fruit with the longitudinal axis substantially co-axial with the longitudinal axis of the box was retained.

The kiwifruit was still packed on its side and the package which included a moulded green plastic tray housed in a shallow box became the common kiwifruit package which could be fairly described as the "industry standard". The same or similar packaging has been adopted in other parts of the world where kiwifruit is now grown.

The kiwifruit is regarded by many as a costly item of food and as a luxury, especially by the time that it reaches export markets. Even in a home market such as New Zealand, kiwifruit is relatively expensive and is considered to be a luxury by the majority of the public. For this reason, kiwifruit is not always eaten as a whole, but is often cut into slices for decoaration such as on cakes, deserts, and the like.

It will be appreciated therefore that any damage to the sides of the fruit is particularly serious from a marketing point of view. Thus, the manner of packaging kiwifruit up until this time, involving kiwifruit lying on their sides with the longitudinal axes thereof substantially co-axial or parallel with the longitudinal axis or horizontal plane of the tray, has involved the sides being damaged, squashed, bruised and the like. Given that the kiwifruit is often sliced transversely across the longitudinal axis of the fruit, into thin slices or wedges (such as for decoration as referred to hereinbefore), such damage can be particularly serious from a marketing point of view.

In addition, because of distances between growers and markets, (both home markets and export markets), storage and transportation costs are major factors in the cost to the consumer. It is important therefore to ensure that packages are as efficient as possible both with respect to the protection of the kiwifruit and with respect to elimination of unused volume. We have found that maximum use is not made of tray area, by lying the kiwifruit down on their sides, with their longitudinal axes substantially co-axial with the transverse or horizontal axis of the trays.

The present invention sets out to provide an efficient and straight forward means for the packaging of kiwifruit.

The present invention also sets out to overcome and at least minimise the problems encountered with packaging kiwifruit up until this time.

BRIEF SUMMARY OF THE INVENTION

According to one aspect of this invention there is provided a method of packaging kiwifruit and packaging means formed or provided with one or more pockets therein; said method including locating at least one kiwifruit in at least one pocket, so that the longitudinal axis of the kiwifruit is substantially vertical or upright.

According to a further aspect of this invention there is provided a method of packaging kiwifruit in one or more trays including a plurality of juxtaposed pockets; including locating kiwifruit within a plurality of pockets in said at least one tray, such that the kiwifruit have their axes substantially vertical or upright.

According to a further aspect of this invention there is provided a method of packaging kiwifruit in a plurality of trays, each tray being formed with a plurality of juxtaposed pockets therein; including locating kiwifruit in a plurality of pockets in said trays, in such a manner that the longitudinal axes of the kiwifruit are substantially vertical or upright; a plurality of the pockets in each of said trays being provided with deformable nipples on the bases thereof, the trays of kiwifruit being stacked one on top of the other, and within an outer container; the deformable nipples of a lowermost tray resting on a base of said container; the deformable nipples of upper trays resting on ends of kiwifruit in a tray immediately therebelow.

According to a further aspect of this invention, there is provided a packaging tray for kiwifruit including at least one pocket formed therein; said pocket being adapted to house and locate at least one kiwifruit in a position such that the longitudinal axis thereof is substantially vertical or upright.

According to a further aspect of this invention, there is provided a packaging arrangement for kiwifruit, including at least two trays each having a plurality of juxtaposed pockets formed therein, the pockets being so formed and shaped as to receive and hold kiwifruit therewithin, such that the kiwifruit have their longitudinal axes substantially vertical or upright; a plurality of pockets of each tray having at least one deformable nipple on the bases thereof, said at least two trays housing and locating kiwifruit and being placed one on top of the other, such that the deformable nipples on the bases of the pockets in an upper tray rest on ends of kiwifruit in pockets in a tray immediately therebelow.

BRIEF DESCRIPTION OF THE DRAWINGS

This invention will now be described by way of example only, and with reference to the accompanying drawings, wherein.

DETAILED DESCRIPTION OF PREFERRED EMBODIMENTS

Figure 1:
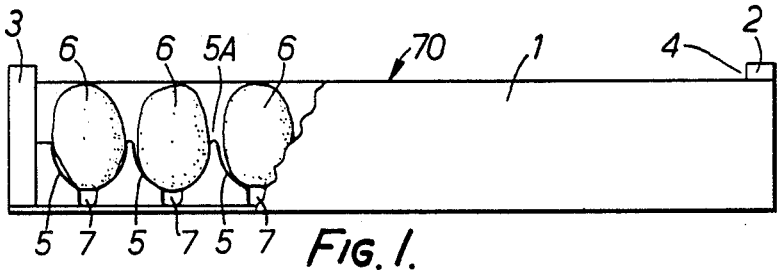
FIG. 1: is a partial sectional elevational view of a container including a tray for packaging kiwifruit accordining to one form of the invention.

In the present invention packaging for kiwifruit usually includes an outer container having for example a base and side members, with an open top which is capable in some instances of being closed over.

The present invention is characterised in that whereas in the present packaging of kiwifruit, described hereinbefore as "the industry standard", the kiwifruit has been packed laying on its side (for example) with the longitudinal axis of the kiwifruit being substantially parallel to a transverse axis or horizontal plane of a tray. In the present invention the kiwifruit is packed on end; that is, with the longitudinal axis of the kiwifruit being substantially vertical or upright. We will, by way of example, refer to the prior art or "industry standard" orientation of the kiwifruit as horizontal and the orientation used in the present invention as vertical. It will be appreciated however that in the present invention we are describing an orientation where the kiwifruit is substantially vertical or upright, in comparison with the prior art horizontal orientation, the term vertical including kiwifruit packed at an angle approaching the vertical.

We have found that the present invention, with the orientation of the kiwifruit substantially vertical or upright, has several advantages which are commercially very significant. As well as resulting in improved fruit quality in the market through less damage, the substantially vertical orientation results in higher density packing which lowers the cost of packaging, cool storage and transportation. For example, in the packaging presently in use, thirty-six kiwifruit of an average weight of 100 grams are packed per tray, giving a net fruit weight of 3.6 kg per pack. Using the present invention forty-nine kiwifruit of 102 grams each can be packed in the same tray area, giving a net fruit weight of 3.6 kg per tray for example. As the trays can be packed with more than one layer per box in the present invention, a package holding 10 kg of fruit for example can be provided compared with the present 3.6 kg pack. A two layer 10 kg pack with the orientation of the kiwifruit substantially vertical can give 20% more fruit per unit volume, with very significant savings in packaging, cool storage and transportation for example.

In the present invention, outer containers are in one form of the invention, formed or fabricated of a relatively light wooden material or composite material, the preferred form of the invention having an outer container with solid wooden ends, sides and bottom being of some other material. Suitable material for the sides and bottom of the composite box includes for example solid fibre board or cardboard, corrugated cardboard and paper-faced wooden veneer. These are however by way of example.

In other forms of the invention, the outer container could for example be constructed of a suitable plastics material or indeed any other material capable of being used in storage and transport.

A preferred form of container, according to the present invention, is provided with ends which are relatively solid and capable of resisting compressive forces, such as are generated when containers and packages are stacked one on top of the other.

This has been found important, to ensure that compressive force which is generated by stacking is taken by the outer container or package, rather than the fruit within the container, which may otherwise be damaged.

It is usual to stack the packages one on top of another on a pallet to produce a unitised load to suit cool store racking systems, I.S.O. containers and general shipping. The unitised loads on pallets are often stacked too high.

It has been found that a relatively simple solution to providing suitable ends for the containers or packages is to use solid wood. Other materials such as solid fibre board or moulded plastics may also be used however. Where moulded plastics are used, these may for example be provided with slots adapted to receive the sides of the box as a fastening means. Generally speaking however, solid wood is preferred as the material for use in the ends of the outer containers, as it is readily available and is relatively inexpensive. It also provides a simple solution to the fastening of sides thereto.

Where the ends of the outer container are made from solid wood, the sides and bottom formed of some other material may be simply connected or fastened thereto using conventional fastenings such as staples adhesives, bonding agents and the like. Other fastenings however, such as purpose-made clips may be used.

It is preferred that the ends of the outer containers or packages be raised above the sides, so that when packaging, or stacking, any forces are transmitted through the ends only, to again avoid compressing and damaging the fruit.

Preferred materials by way of example, for use in the sides and bottom of the outer containers, are solid fibreboard and paper-faced veneer. Of these the most preferred material has been found to be paper faced veneer.

Paper-faced veneer has the particular advantage of low cost, relative stiffness (especially when exposed to dampness or high humidity) and its freedom from organisms since the material is usually sterilised in high temperatures encountered in the veneer dryer.

Where solid wood ends are used for the outer containers or packaging, the paper-faced veneer may be fastened to these simply with nails, staples, adhesives or bonding agent. By laminating pieces of veneer between paper faces, the paper-faced veneer sides and bottom may be provided as a single component which can be simply folded around the ends and fastened thereto.

Where, in various forms of the invention, the container of the present invention includes more than one layer of packaging trays (as will be described hereinafter), fruit ventilation holes may be provided in the sides of the outer container, to allow for the free passage of air especially during cooling of the contents. The cooling of the contents, being kiwifruit, has been particularly advantageous with the effective storage of kiwifruit for long periods. As indicated hereinbefore, the effective storage of kiwifruit is essential having regard to the distance between grower and markets (both home and export).

The ventilation holes may be of any suitable shape and configuration, although we have found that it is advantageous to use holes which will not allow the penetration of a finger during lifting of the boxes as this can damage the fruit. Thus, to provide sufficient ventilation area without allowing the holes to become too large, they may be provided in the form of slots or elongate holes.

While the outer container or package described and referred to hereinbefore is preferred, it should be appreciated that in using the packaging trays of the present invention (to be described hereinafter) any appropriate container or package can be provided and used.

One of the real advantages of the present invention, in comparison with prior art kiwifruit packaging, is that a plurality of layers of kiwifruit can be packaged and transported. As indicated hereinbefore, packaging of more than one layer of kiwifruit in the manner used up until this time has meant that there is a real and substantial danger of damage to the kiwifruit. This is avoided, or at least substantially diminished, by the use of the present invention.

The present invention therefore, provides a tray which can be used on its own, or with one or more other trays, and in which the kiwifruit is able to be held and located, in such a position in which its longitudinal axis is vertical or upright. In one form of the invention it is at substantially right angles or perpendicular to a horizontal plane of a tray. This is in comparison with the prior art packaging of kiwifruit, wherein the longitudinal axis of the kiwifruit has always been substantially horizontal or substantially co-axial or parallel to the horizontal plane or transverse axis of the tray.

While in the preferred forms of the invention the trays are formed with a plurality of adjacent but spaced apart pockets or holes, it is envisaged that in special cases (such as for specialist packaging), a smaller package can be provided which can mount, and package (and display) a single kiwifruit.

Normally, the packaging trays will be formed of a suitable resilient or flexible plastic material, and will have cups or pockets formed therein; for example by moulding and the like. The lower surface of the pockets or cups will either rest on the inside of a container (where the tray is the bottom or lower tray of a number of trays), or will rest on top of kiwifruit in another tray immediately therebelow. In these cases, compressive forces of the fruit within a container immediately above (that is the compressive force of fruit on fruit), is transmitted through the longitudinal axes of the kiwifruit. With the objective of investigating the ability of kiwifruit to resist loads and in particular loads through the longitudinal axis thereof, we have compressed kiwifruit through their longitudinal axes (that is substantially end to end) and in their short axial direction (that is substantially side to side). These tests were conducted on several occasions, in all cases using Grade 1 Hayward variety kiwifruit which were firm and considered to be of export quality. Typical results are set out in Table 1 below.

TABLE 1

| Fruit | Load(N) | Fruit | Load(N) |
|---|---|---|---|
| | End-on Compression | | |
| 1 | 118 | 10 | 142 |
| 2 | 101 | 11 | 132 |
| 3 | 174 | 12 | 114 |
| 4 | 149 | 13 | 175 |
| 5 | 137 | 14 | 167 |
| 6 | 125 | 15 | 166 |
| 7 | 195 | 16 | 153 |
| 8 | 135 | 17 | 156 |
| 9 | 151 | 18 | 119 |
| Average load(N) = 144.9 | | | |
| Standard Deviation = 24.8 | | | |
| | Side-on Compression | | |
| 19 | 81 | 28 | 81 |
| 20 | 71 | 29 | 72 |
| 21 | 90 | 30 | 73 |
| 22 | 99 | 31 | 81 |
| 23 | 86 | 32 | 69 |
| 24 | 82 | 33 | 105 |
| 25 | 72 | 34 | 103 |
| 26 | 92 | 35 | 85 |
| 27 | 87 | 36 | 95 |
| Average load(N) = 84.7 | | | |
| Standard Deviation = 11.1 | | | |

The end point taken in the test is the force required to compress the kiwifruit 6 mm, which in our opinion, caused unacceptable bruising when the force was applied to the side of the fruit having regard to the fact that the fruit is often cut and used for decorative and display purposes (as referred to hereinbefore). However, 6 mm compression to the longitudinal axis of the kiwifruit (that is end on end) caused much less damage, having regard to the use to which the fruit is put. It is acknowledged that damage to the fruit must be kept to an absolute minimum, in that bruising could initiate rot or deterioration before the fruit reaches market places. Further reference to Table 1 will show that although the kiwifruit is commonly packed on its side, it requires about 70% more load to cause the same compression when the load is applied substantially end on end (or through the longitudinal axis).

It is for this reason that we have discovered that there are substantial commercial and practical advantages in locating the kiwifruit in packaging trays with the longitudinal axes substantially vertical or upright, or in one form of the invention, substantially perpendicular to the horizontal plane of the tray.

As has been referred to hereinbefore, this orientation allows the fruit to be packaged more than one layer high if desired, (compared with the generally accepted present single layer packaging), especially when the pockets of the packaging trays of the present invention are provided with deformable cushion feet or nipples as will be described hereinafter.

The packaging trays of the present invention, are preferably formed with a plurality of cups or pockets therein, and are preferably made from such material as wood pulp, or plastics. Plastic material can for example be poly-vinyl chloride, polyethylene or polypropylene. The plastic is preferably but not essentially thermoplastic which may be moulded or formed such as for example vacuum formed. It is frequently found that plastic copolymer sheet material is used for vacuum forming. Such copolymer sheet material may be used in the present invention. The plastic sheet material can be solid or foamed.

The shape of the cups or pockets (in plan view) in the trays according to the present invention may be of any suitable shape and configuration.

However, while at first sight one might expect the shape of the kiwifruit pockets to be substantially rounded or circular, a close examination of kiwifruit (when cut transverse, or at right angles to the longitudinal axis), shows that while in cross section they are generally round, they are quite typically slightly oval in varying amounts and degrees. It has been found that even when kiwifruit is grouped together in general increments of size or weight, there is still a relatively wide variation between one fruit and the other. For this reason we have found that it is desirable that a pocket be formed of a size and configuration, so as to accommodate a variety of kiwifruit shapes.

We have found in experimentation that a polygon cross-sectional shape is preferred as this will easily deform to accept kiwifruit of varying shapes. A preferred effective shape for example is a hexagon, since this can be readily designed into the generally rectangular shape of the kiwifruit package.

Another advantage however of a polygon shaped pocket, in conjunction with the fruit being arranged with their longitudinal axes substantially vertical or upright, is that more fruit can be contained in a given volume, when compared with prior art packaging. It should be appreciated in any event that by locating the kiwifruit with their longitudinal axes substantially vertical, or upright, a greater number of kiwifruit per tray can be provided for, in comparison to the number of kiwifruit located in a tray when the kiwifruit were positioned on their sides.

We refer now to FIG. 1 of the accompanying drawings, which shows an outer container or package locating a single packaging tray for kiwifruit, in accordance with the present invention.

The outer container 70 has sides 1, and ends 2, and 3. The ends 2 and 3 are shown as protruding above the sides 4, at the ends thereof, so that when the packages are stacked one on top of the other, at least some of the compressive forces of the stack are taken by the ends 2 and 3 are are not transmitted into the container and onto the fruit. Within the container is a single plastic tray, preferably being a moulded plastic tray having a plurality of adjacent and spaced apart pockets 5, which are shaped to hold kiwifruit in an upright position with their longitudinal axis substantially vertical or upright. The kiwifruit are shown as 6 in the accompanying drawing (FIG. 1).

The pockets 5 are integrally formed and moulded into the tray being connected by connecting portions 5a integrally formed with and between the pockets 5.

The bottoms or lower portions of the pockets 5 are provided or formed into deformable cushion feet or nipples 7, which are integrally formed at the bottom of the pockets or cups 5 and which are formed of a deformable and compressible resilient plastics material. Thus, in use, the kiwifruit 6 are supported on and by the deformable nipples 7. On the kiwifruit 6 being placed into the pockets 5, the nipples 7 compress and thus prevent or minimise contact of the kiwifruit against the bottom of the tray.

It has been found in use, that a pack as shown in FIG. 1 of the drawings, holds more kiwifruit than the conventional kiwifruit pack, and thus there is a saving in cost per unit fruit.

Figure 2:
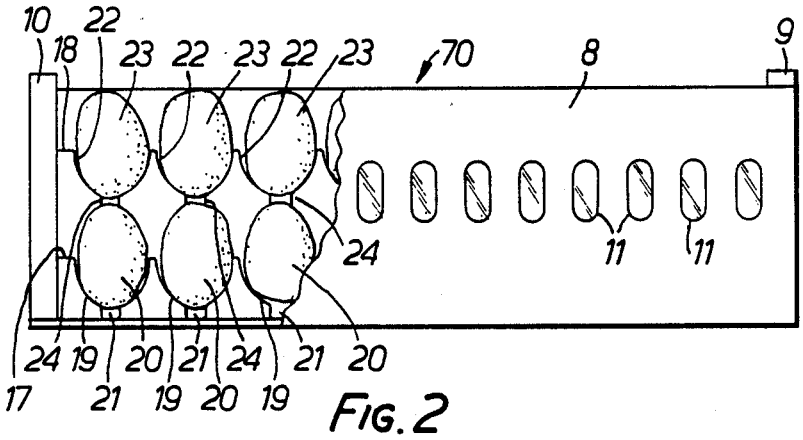
FIG. 2: is a partial sectional view of package for packaging kiwifruit according to a further aspect of the invention.

We refer now to FIG. 2 of the accompanying drawings which shows a further embodiment of the present invention. In FIG. 2 of the drawings, two layers of kiwifruit are provided and arranged in an outer container 70. In FIG. 2, we show a side elevation cut away so that the arrangement and location of kiwifruit within the outer container 70 can be seen.

In FIG. 2, the outer container 70 is shown having sides 8 and ends 9 and 10. The ends 9 and 10 are again raised above the sides 8. The sides 8 of the container have a plurality of ventilation holes or slots 11 cut therein, the ventilation holes or slots preferably being of such a size as to provide adequate ventilation for the fruit within, but preferably being sufficiently small to avoid fingers or hands from penetrating during handling of the containers. As indicated hereinbefore, the insertion of fingers through such holes could well come into contact with the fruit and thus cause damage to the fruit.

Within the outer container 70 are two trays for packaging kiwifruit, the trays being 17 and 18.

The lower tray 17 has a plurality of cups or pockets 19, formed therein, and so shaped as to hold kiwifruit 20 with their longitudinal or "end on end" axes substantially vertical or upright and at substantially right angles to the horizontal plane of the tray. The bottoms of the pockets 19 in tray 17 (or at least some of the pockets) are provided with deformable and resilient nipples 21, which rest on the bottom of the outer container to support the kiwifruit 20. A second tray 18 also has pockets 22 shaped to hold kiwifruit 23 with their longitudinal axes substantially vertical or upright. The second tray 18 having pockets 22, also has deformable nipples 24 extending downwardly from the lower surface or base of the pockets 22. The nipples 24 rest on the ends of the kiwifruit 20 in the tray 17 below.

In a further form of the invention a separator sheet of suitable material (not shown) may be provided between each tray of fruit, in which case the bases of the cups (with or without the nipples) rest on the separator sheet which in turn rests on the fruit in the tray below.

As will be appreciated kiwifruit packaging according to the present invention can be made with any number of trays placed one on top of the other, within the limitation that the lowermost fruit must be able to bear the load of the fruit above, the load preferably being transmitted via the deformable nipples provided in the base of the pockets of the trays.

As described hereinbefore, it has however been found that the transmission of load or compression along the longitudinal axis of kiwifruit is not nearly as damaging (if damaging at all) as forces passed through or applied to the short (or side to side) axis of the kiwifruit.

In addition, the use of the deformable nipples on the lower surfaces or bases of the pockets forms a compressed unit separating the actual fruit one from the other, this also assisting in maintaining the standard of the fruit.

Thus, while the invention has been described with reference to one and two layers of kiwifruit, it should be appreciated that the invention has equal application to any number of layers of kiwifruit. It will be appreciated therefore that the invention has application to one layer of kiwifruit packaging, two layers, three layers, or even four.

As has been stated hereinbefore, although the cross section of kiwifruit along the short (or side to side) axis is generally round, the fruit is often found to be oval to some extent. It is therefore essential to take this into account when considering the shape of the pockets as otherwise oval fruit could not be effectively packed. Thus, while the pockets may be round in cross-section, and may be expected to deform to take oval fruit, it is more desirable that they be in the form of a polygon as the polygon can deform as necessary to the shapes of kiwifruits.

In particular it has been found that a hexagonal shaped pocket (in transverse cross-section) is advantageous.

Up until this time, it has been found in kiwifruit packaging, that it is desirable to wrap the tray of fruit with a plastic film. The plastic film usually assists in retaining a high humidity in the proximity of the fruit, which prevents loss of water from the fruit.

While the wrapping of the trays with plastic film is seen as time consuming, it is effective in retaining the quality of the fruit, and no satisfactory alternative has yet been found. The plastic film or waxed paper may be used in the packages of the present invention for the purpose of reducing loss of water from the fruit. Where more than one layer of fruit is contained in the package it is preferred that each layer be wrapped separately with plastic film so that air can be passed between the layers during storage.

In the conventional prior art kiwifruit packaging, the outer container or box is fitted with a loose lid. The purpose of this lid is primarily to protect the contents of the container from contamination by dust and dirt. A lid may be fitted to the outer containers of the present invention if desired, including the prior art lid presently used in kiwifruit packaging. Alternatively, some other design of lid may be used such as a hinged lid for example.

We believe that the invention described herein will not only prove to be of considerable commercial advantage in the packaging of kiwifruit in New Zealand, but will eventually be appreciated and adopted in other regions of the world where kiwifruit is grown and marketed.

It should be appreciated that this invention has been described by way of example only and that improvements and modifications may be made without departing from the scope or spirit thereof as defined by the appended claims.

We claim:

1. A method of packaging kiwifruit in packaging means having a plurality of pockets comprising:
   - providing packaging means in the form of trays each having a plurality of pockets therein;
   - locating kiwifruit upright within a plurality of pockets in a plurality of said trays with the longitudinal axis of said kiwifruit substantially vertical; and
   - placing an upper tray on a lower tray so that bases of pockets of the upper tray rest on ends of kiwifruit in the lower tray.

2. A method of packaging kiwifruit in packaging means having a plurality of pockets comprising:
   - providing packaging means in the form of trays each having a plurality of pockets therein;
   - providing deformable nipples on the bases of said pockets;
   - locating kiwifruit upright within a plurality of pockets in a plurality of said trays with the longitudinal axis of said kiwifruit substantially vertical;
   - providing an outer container; and
   - stacking said trays on top of one another, and placing said trays within said outer container, so that deformable nipples of a tray on top of another tray rest on ends of kiwifruit in a tray immediately therebelow.

* * * * *